US005901402A

United States Patent [19]

Williams

[11] Patent Number: 5,901,402

[45] Date of Patent: May 11, 1999

[54] MOP HANDLE CONNECTOR

[76] Inventor: Stephen R. Williams, 530 Turkey Trail, Shreveport, La. 71115

[21] Appl. No.: 08/895,308

[22] Filed: Jul. 16, 1997

[51] Int. Cl.[6] ..... B25G 3/38

[52] U.S. Cl. ..... 15/144.1; 15/150; 15/229.6

[58] Field of Search ..... 15/144.1, 145, 15/147.1, 150, 154, 176.2, 228, 229.1, 229.6

[56] References Cited

U.S. PATENT DOCUMENTS

| | | | |
|---|---|---|---|
| 501,823 | 7/1893 | Caldwell | 15/150 |
| 2,050,762 | 8/1936 | Preisser et al. | 15/147.1 |
| 2,286,655 | 6/1942 | Supnick . | |
| 2,861,287 | 11/1958 | Scalf | 15/150 |
| 3,006,668 | 10/1961 | Stewart . | |
| 3,440,677 | 4/1969 | Flomerfelt | 15/144.1 |
| 4,407,039 | 10/1983 | Moss | 15/150 |
| 4,928,342 | 5/1990 | Friedman et al. | 15/147.1 |
| 5,048,237 | 9/1991 | Lankry . | |
| 5,207,754 | 5/1993 | Harrah . | |
| 5,243,729 | 9/1993 | Tomm . | |
| 5,297,887 | 3/1994 | Williams | 15/176.2 |
| 5,615,442 | 4/1997 | Schroeck . | |

*Primary Examiner*—Terrence R. Till
*Attorney, Agent, or Firm*—John M. Harrison

[57] ABSTRACT

A mop handle connector which is removably attached to the end of a mop handle and is typically fitted with a clamp to facilitate removable attachment of a dust mop frame to the mop handle. In a preferred embodiment the mop handle connector is characterized by a connector plate, one end of which is threaded into the end of the mop handle and a conventional clamping mechanism is pivotally attached to the opposite end of the connector plate. A lock ring may be slidably disposed on the connector plate and can be selectively brought into engagement with the clamping mechanism to maintain the attached dust mop frame in a rigid position with respect to the mop handle, or disengaged from the clamping mechanism to allow the attached dust mop frame to pivot with respect to the mop handle.

9 Claims, 1 Drawing Sheet

MOP HANDLE CONNECTOR

BACKGROUND OF THE INVENTION

1. Field of the Invention

This invention relates to mops and more particularly, to a mop handle connector, one end of which is threaded for insertion in the end of a mop handle and the other end having a pin opening for receiving a pivot pin and mounting a conventional pivoting clamp mechanism, to which is removably attached a dust mop frame of various design. In a preferred embodiment the mop handle connector is characterized by an elongated, flat connector plate having a threaded plate nipple on one end, which plate nipple is threaded into the internally-threaded end of the mop handle. A conventional clamping mechanism is typically pivotally attached to the opposite end of the connector plate by means of a pivot pin extending through a pin opening in the plate. A lock ring may be slidably disposed on the connector plate and can be selectively brought into engagement with the clamping mechanism to maintain the attached dust mop frame in a rigid configuration with respect to the mop handle. Alternatively, the lock ring can be disengaged from the clamping mechanism, thus allowing the attached dust mop frame to pivot with respect to the mop handle, as desired.

In conventional wringer-type mops, including string-type mops, as well as dry mops, the head element for the mop is typically formed from multiple, moisture-absorbent or dust-attracting strands, such as cotton strands. The strands are normally attached to a mop handle by various means, and because the dust mop frame is usually fixed to the mop handle, only one dust mop frame can be used with each handle. Furthermore, because the dust mop frame is usually rigidly attached to the handle, applications of the mop which might require pivoting of the dust mop frame with respect to the handle in order to reach otherwise inaccessible areas, are prevented.

2. Description of the Prior Art

U.S. Pat. No. 2,286,655, dated Jun. 16, 1942, to Frederick Supnick, describes a "Mop Handle and the Like", characterized by a shaft which is pivotally attached to the end of a mop handle, into which is fastened a dust mop frame. The pivoting shaft may be positioned at any desired angle with respect to the mop handle to facilitate a variety of cleaning operations, and a lock ring is provided on the end of the mop handle for engagement with the shaft in order to maintain the shaft and dust mop frame in a rigid configuration with respect to the mop handle. U.S. Pat. No. 3,006,668, dated Oct. 31, 1961, to Roger B. Stewart, discloses a "Lockable Universal Implement Head" for the attachment of floor cleaning devices such as mops, dusters and the like, to a handle. The implement head is characterized by a universal joint which is attached to the end of a handle and receives the dust mop frame or other cleaning implement. The joint can be locked into position, permitting relative movement in one plane only, between the attached implement and the handle, where additional control is desired for reaching normally inaccessible areas for cleaning. An "Attachment For A Power Tool" is disclosed in U.S. Pat. No. 5,048,237, dated Sep. 17, 1991, to Julien Lankry. The attachment includes a drive shaft for driving connection to the tool and a rotatable disc linked transversely to the drive shaft. The link between the disk and shaft is formed by a flexible membrane which permits relative angular movement between the disc and shaft. A locking mechanism is provided on the attachment for enabling the disc to be selectively held substantially rigidly with respect to the shaft. U.S. Pat. No. 5,207,754, dated May 4, 1993, to David W. Harrah, describes a "Quick-Release Connector For Mop Handles and the Like", having a handle section for attachment to a mop handle and a head section for attachment to a dust mop frame. The handle section is provided with multiple receptacles for receiving respective projections provided in the head section. The handle section is further provided with a shallow recess which mates with a correspondingly-shaped protrusion in the attached head section to provide resistance to torsional stress applied to the connector during cleaning operations. A "Mop Frame Holder" is detailed in U.S. Pat. No. 5,243,729, dated Sep. 14, 1993, to Erwin Tomm. The mop frame holder is characterized by a housing having a slot for receiving a portion of a mop frame, a cover plate slidably engagable with the housing for selectively covering the slot to facilitate locking the frame portion within the slot, a releasable device for locking the cover plate to the housing when the slot is covered and a mechanism for connecting a mop handle to the housing. U.S. Pat. No. 5,615,442, dated Apr. 1, 1997, to Harold J. Schroeck, et al, details a "Mop Including Mop Connector". The mop is characterized by a handle and a head portion having multiple mop strands, along with an improved connector for connecting the mop strands to the handle. The connector includes a connector body having a collar portion and a hollow shank portion. A strand clip is provided for engaging the mop strands and includes a pair of legs for engaging the shank portion of the connector body, such that the strand clip is attached to the connector body.

An object of this invention is to provide a mop handle connector for removably joining dust mop frames of selected design to a common mop handle.

Another object of this invention is to provide a mop handle connector which is removably attached to one end of a mop handle and receives a conventional dust mop frame attachment mechanism to facilitate removable attachment of a frame of selected design to the mop handle.

Still another object of this invention is to provide a mop handle connector characterized by an elongated connector plate, one end of which is threaded into the end of a mop handle, and further including a pin opening provided in the opposite end for receiving a pin and attaching a conventional clamping or alternative attachment mechanism to the opposite end of the connector plate and receiving dust mop frames of selected design.

Yet another object of this invention is to provide a mop handle connector characterized by an elongated, flat connector plate, one end of which defines a nipple that is threaded into the end of a mop handle and the other end having a pin opening for receiving a pin and pivotally accommodating a conventional clamping mechanism for mounting a dust mop frame of selected design. A lock ring is typically slidably disposed on the connector plate and can be engaged with the clamping mechanism to maintain the dust mop frame in rigid relationship with respect to the mop handle, or disengaged from the clamping mechanism to facilitate pivoting of the dust mop frame with respect to the mop handle, as desired.

A still further object of this invention is to provide a mop handle connector assembly for connecting a mop handle to an attachment clamp or other dust mop frame accessory, which assembly includes an elongated, flat connector plate, one end of which is fitted with a threaded plate nipple for engaging the internally-threaded mop handle and the opposite end of the plate shaft having an opening for receiving a pivot pin and engaging the pivoting mechanism of the conventional clamp or alternative dust mop frame accessory. Optionally included is a lock ring slidably fitted on the connector plate for selectively engaging a pivoting element of the clamp mechanism to facilitate operation of the dust mop frame with the clamp mechanism either in pivoting or non-pivoting mode.

SUMMARY OF THE INVENTION

These and other objects of the invention are provided in a mop handle connector that includes an elongated, flat, metal connector plate fitted with a threaded plate shaft or nipple on one end for removably threadably engaging corresponding internal threads in a mop handle. The connector plate has a pin opening in the opposite end thereof from the nipple, for receiving a pin and pivotally attaching a conventional dust mop frame attachment clamp to the connector plate. In another embodiment of the invention the mop handle connector includes a lock ring slidably provided on the connector plate for selectively engaging a pivoting flange in the dust mop frame attachment clamp and facilitating operation of the mop with the frame attachment clamp in fixed or pivoting configuration, depending upon the position of the sliding lock ring.

BRIEF DESCRIPTION OF THE DRAWING

The invention will be better understood by reference to the accompanying drawing, wherein.

DESCRIPTION OF THE PREFERRED EMBODIMENTS

Figure 3:
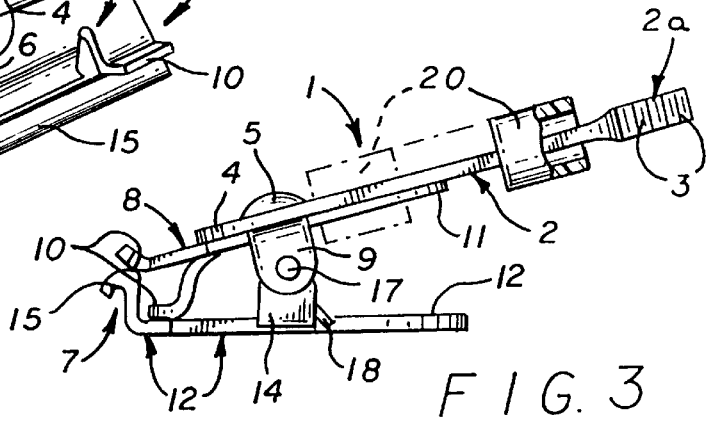
FIG. 3 is a side view of the mop handle connector attached to the conventional clamping mechanism illustrated in FIGS. 1 and 2.
Figure 4:
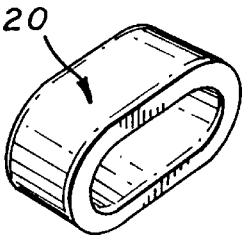
FIG. 4 is a perspective view of a lock ring element for use with the mop handle connector.
Figure 5:
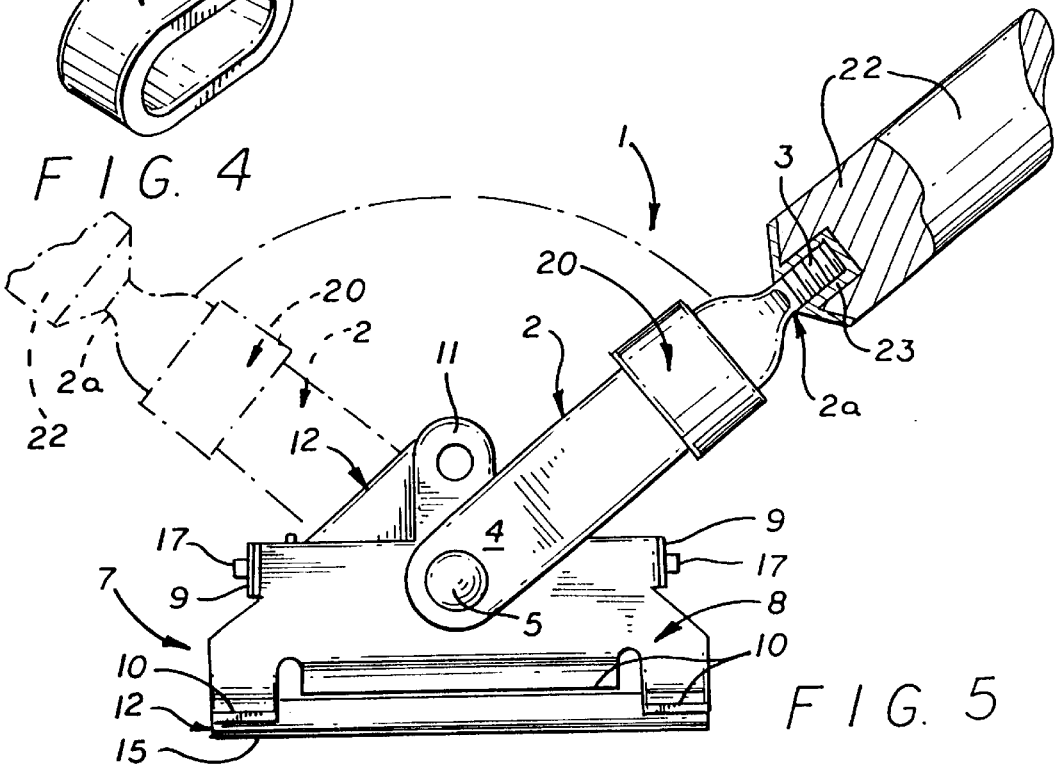
FIG. 5 is a top view of the mop handle connector, more particularly illustrating pivoting movement of the mop handle and attached connector plate with respect to the conventional clamping mechanism.

Referring initially to FIGS. 1–5 of the drawing, in a preferred embodiment the mop handle connector of this invention is generally illustrated by reference numeral 1. The mop handle connector 1 is characterized by an elongated, flat connector plate 2, one end of which is tapered and provided with a plate nipple 2*a*, having nipple threads 3, which engage corresponding internal handle threads 23, provided in the receiving end of a mop handle 22, as illustrated in FIG. 5. The opposite end of the connector shaft 2 terminates in a radiused clamp attachment end 4, having a pin opening 6 that receives a clamp pivot pin 5, to which is typically pivotally attached a dust mop frame attachment clamp 7 of conventional design. The clamp pivot pin 5 extends through the pin opening 6 in the clamp attachment end 4 of the connector plate 2 and is anchored in a stationary clamp member 8 of the dust mop frame attachment clamp 7. The conventional dust mop frame attachment clamp 7 is typically provided with a pair of spaced-apart stationary clamp pivot flanges 9, between which is positioned a pair of mobile clamp pivot flanges 14, as illustrated in FIG. 3. A pivot rod 17 extends through aligned openings (not illustrated) provided in the stationary clamp pivot flanges 9 and mobile clamp pivot flanges 14, to allow pivotal movement of the mobile clamp member 12 with respect to the stationary clamp member 8. A coiled clamp spring 18, seated on the pivot rod 17, includes one end which engages the stationary clamp member 8, and the opposite end of the clamp spring 18 engages the mobile clamp member 12, such that the mobile clamp-engaging flange 15 on the mobile clamp member 12 normally engages the stationary clamp-engaging flanges 10, provided on the stationary clamp member 8, as illustrated in FIG. 3. Pressure applied to the rear of the mobile clamp member 12 facilitates pivoting of the mobile clamp member 12 with respect to the stationary clamp member 8 against the pressure exerted by the clamp spring 18, thereby opening the dust mop frame attachment clamp 7 in conventional manner to allow removable attachment of a dust mop frame (not illustrated) of selected design to the mop handle connector 1.

Figure 1:
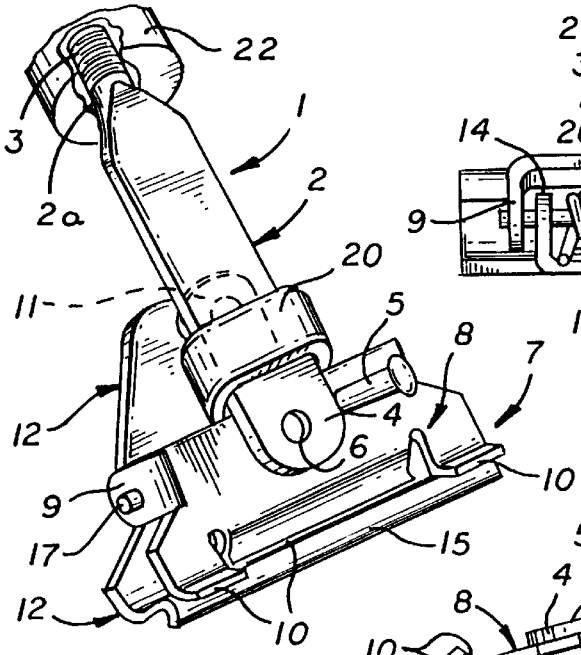
FIG. 1 is a perspective view of a preferred embodiment of the mop handle connector of this invention, with one end attached to a conventional pivoting clamping element and the opposite end threadably attached to the internally threaded end of a mop handle.
Figure 2:
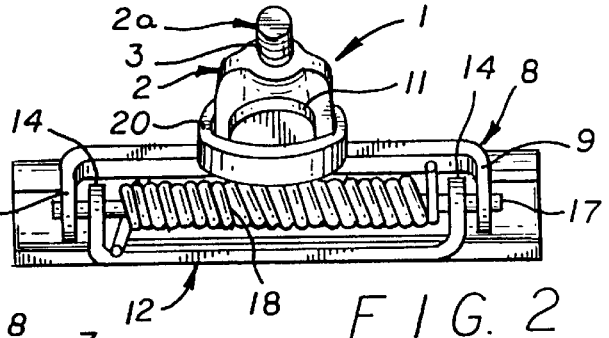
FIG. 2 is a rear view of the mop handle connector attached to the conventional clamping mechanism illustrated in FIG. 1.

As further illustrated in FIGS. 1, 3 and 4 of the drawing, a clamp lock ring 20, preferably constructed of a resilient material such as polyethylene, polypropylene or other plastic, may be slidably disposed on the connector plate 2. The clamp lock ring 20 can occupy a rear position on the connector plate 2 adjacent to the mop handle 22, to allow pivoting of the dust mop frame attachment clamp 7 with respect to the connector shaft 2 and mop handle 22, as illustrated in FIG. 5 and achieve certain swiveling or pivoting cleaning capabilities of the attached dust mop frame (not illustrated). Alternatively, the clamp lock ring 20 may be displaced forwardly on the connector shaft 2, as illustrated in FIGS. 1 and 3, to engage a clamp lock flange 11, which extends rearwardly from the stationary clamp member 8, and thereby lock the dust mop frame attachment clamp 7 and attached dust mop frame (not illustrated) in a rigid, non-pivoting configuration with respect to the mop handle 22, for cleaning operations where rigidity of the dust mop frame (not illustrated) with respect to the mop handle 22 is desired.

It will be appreciated by those skilled in the art that the mop handle connector of this invention facilitates matching a dust mop frame of selected design with a single mop handle which is fitted with internal threads for receiving the mop handle connector. Accordingly, only a single mop handle need be placed in storage with multiple wet and/or dry or dust mop frames for selection and use as deemed necessary.

While the preferred embodiments of the invention have been described above, it will be recognized and understood that various modifications may be made in the invention and the appended claims are intended to cover all such modifications which may fall within the scope and spirit of the invention.

Having described my particularity set forth above, what is claimed is:

1. A mop handle connector for connecting a mop handle to a dust mop frame, said mop handle connector comprising a connector plate; threads provided on one end of said connector plate for threadibly engaging the mop handle; an opening provided on the opposite end of said connector plate for pivotally securing said opposite end of said connector plate to the dust mop frame; and lock ring means slidably provided on said connector plate for selectively engaging the dust mop frame and preventing pivoting of said connector plate with respect to the dust mop frame.

2. The mop handle connector of claim 1 wherein said lock ring means comprises a substantially elliptically-shaped lock ring.

3. The mop handle connector of claim 2 wherein said lock ring is constructed of a plastic material.

4. A mop handle connector for connecting a mop handle having internal threads in one end thereof to a pivoting dust mop frame attachment clamp having a pivot pin, said mop handle connector comprising an elongated connector plate; a threaded nipple provided on said connector plate for threadibly engaging the internal threads in the mop handle; a pin opening provided in said connector plate for receiving the pivot pin and pivotally securing the pivoting dust mop frame attachment clamp to said mop handle connector and lock ring means slidably disposed on said connector plate for selectively engaging the pivoting dust mop frame attachment clamp and preventing the dust mop frame attachment clamp from pivoting on the pivot pin.

5. The mop handle connector of claim 4 wherein said lock ring means comprises a substantially elliptically-shaped lock ring.

6. The mop handle connector of claim 5 wherein said lock ring is constructed of a plastic material.

7. A mop handle connector for connecting a mop handle having internal threads in one end thereof to a pivoting dust mop frame attachment clamp having a pivot pin and a clamp lock flange, said mop handle connector comprising an elongated, flat connector plate; a threaded shaft or nipple provided on one end of said connector plate for threadibly engaging the internal threads in the mop handle and removably securing said mop handle connector to the mop handle; a pin opening provided in the opposite end of said connector plate from said one end for receiving the pivot pin and pivotally securing the pivoting dust mop frame attachment clamp to said mop handle connector and locking means slidably disposed on said connector plate for selectively engaging the clamp lock flange of the pivoting dust mop frame attachment clamp and preventing the dust mop frame attachment clamp from pivoting on the pivot pin.

8. The mop handle connector of claim 7 wherein said lock ring means comprises a substantially elliptically-shaped lock ring.

9. The mop handle connector of claim 8 wherein said lock ring is constructed of a plastic material.

* * * * *